US007476358B2

(12) United States Patent
Rosenzweig et al.

(10) Patent No.: US 7,476,358 B2
(45) Date of Patent: Jan. 13, 2009

(54) METHOD AND APPARATUS FOR BOLTLESS HEAT TREATMENT OF THIN FLANGES

(75) Inventors: Shirley Rosenzweig, West Chester, OH (US); Thomas Hoelle, West Chester, OH (US); Daniel Neal, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 421 days.

(21) Appl. No.: 11/164,561

(22) Filed: Nov. 29, 2005

(65) Prior Publication Data

US 2007/0119526 A1 May 31, 2007

(51) Int. Cl.
*C21D 8/00* (2006.01)
*C21D 1/78* (2006.01)

(52) U.S. Cl. ..... 266/274; 148/646

(58) Field of Classification Search ..... 266/274, 266/287; 148/646

See application file for complete search history.

(56) References Cited

U.S. PATENT DOCUMENTS 2,969,299 A * 1/1961 Fullerton et al. ..... 148/646
4,669,911 A 6/1987 Lundgren et al.
4,709,729 A 12/1987 Harrison
5,379,913 A 1/1995 Ricke et al.
5,815,892 A * 10/1998 Geppert ..... 24/20 R
2003/0005980 A1 1/2003 Kreipe et al.

* cited by examiner

*Primary Examiner*—Scott Kastler
(74) *Attorney, Agent, or Firm*—Adams Intellectual Property Law; William Scott Andes, Esq.

(57) ABSTRACT

A fixture for preventing distortion in a flange of a part during heat treatment. The fixture includes a first support for engaging a bottom surface of the flange, and a second support for engaging a top surface of the flange. A boltless locking ring locks the first and second supports into a fixed position relative to each other and to the flange during the heat treatment. In a method of preventing distortion, the steps include engaging a bottom surface of the flange with a first boltless ring, engaging a top surface of the flange with a second boltless ring, locking the first and second boltless rings into a fixed position relative to each other and to the flange, heat treating the part, unlocking the first and second rings from each other, and removing the first and second rings from engagement with the flange.

10 Claims, 4 Drawing Sheets

METHOD AND APPARATUS FOR BOLTLESS HEAT TREATMENT OF THIN FLANGES

TECHNICAL FIELD AND BACKGROUND OF THE INVENTION

This invention relates generally to a method and apparatus for preventing distortion in thin flanges subject to heat treatment during a repair process. Most aircraft engines have metallic structural parts with thin flanges that may include boltholes and through slots. These types of structural parts are unique and very expensive. The problem with cracked and worn boltholes is a very common type of degradation that occurs during regular engine operation. The use of heat treatment fixtures is often required when making repairs in order to reduce the risk of damage due to deformation. The concept and design of a heat treatment fixture must be carefully calculated to gain the expected results without any unexpected stress concentration Thin flanges with 75% of the area having boltholes or through slots tend to distort over tolerance limits if subject to heat treatments. In most cases, thin flanges have a face that mates with other parts and that requires a tight flatness tolerance. During manufacture such flanges include excess stock material, and final features are machined onto the flanges after heat treatment to avoid deformation. However, some repairs require high temperatures processes, such as welding, stress relief and brazing, that will affect the finished thin flange tolerances and cause deformation. The use of heat treatment fixtures to restrain the deformation and keep the flange flat during high temperatures is well known, but a conventional heat treatment fixture requires bolts or clamps to keep the weight on the correct area of the flange. These bolts or clamps can cause other distortions by restraining small features of the part during growth of the part during the heat treatment. Also, the process of tightening and un-tightening the bolts is labor consuming, requires considerable skill, and increases the cost of the repair

BRIEF DESCRIPTION OF THE INVENTION

According to one aspect of the invention, a fixture is provided for preventing distortion in a flange of a part, such as a turbine engine part, during heat treatment. The fixture includes a first support for engaging a bottom surface of the flange, and a second support for engaging a top surface of the flange. A boltless locking ring locks the first and second supports into a fixed position relative to each other and to the flange during the heat treatment.

According to another aspect of the invention, a method of preventing distortion is provided, and includes the steps of engaging a bottom surface of the flange with a first boltless ring, engaging a top surface of the flange with a second boltless ring, locking the first and second boltless rings into a fixed position relative to each other and to the flange, heat treating the part, unlocking the first and second rings from each other, and removing the first and second rings from engagement with the flange.

BRIEF DESCRIPTION OF THE DRAWINGS

The invention is described below in conjunction with the following drawings, in which.

DESCRIPTION OF THE PREFERRED EMBODIMENT AND BEST MODE

Figure 1:
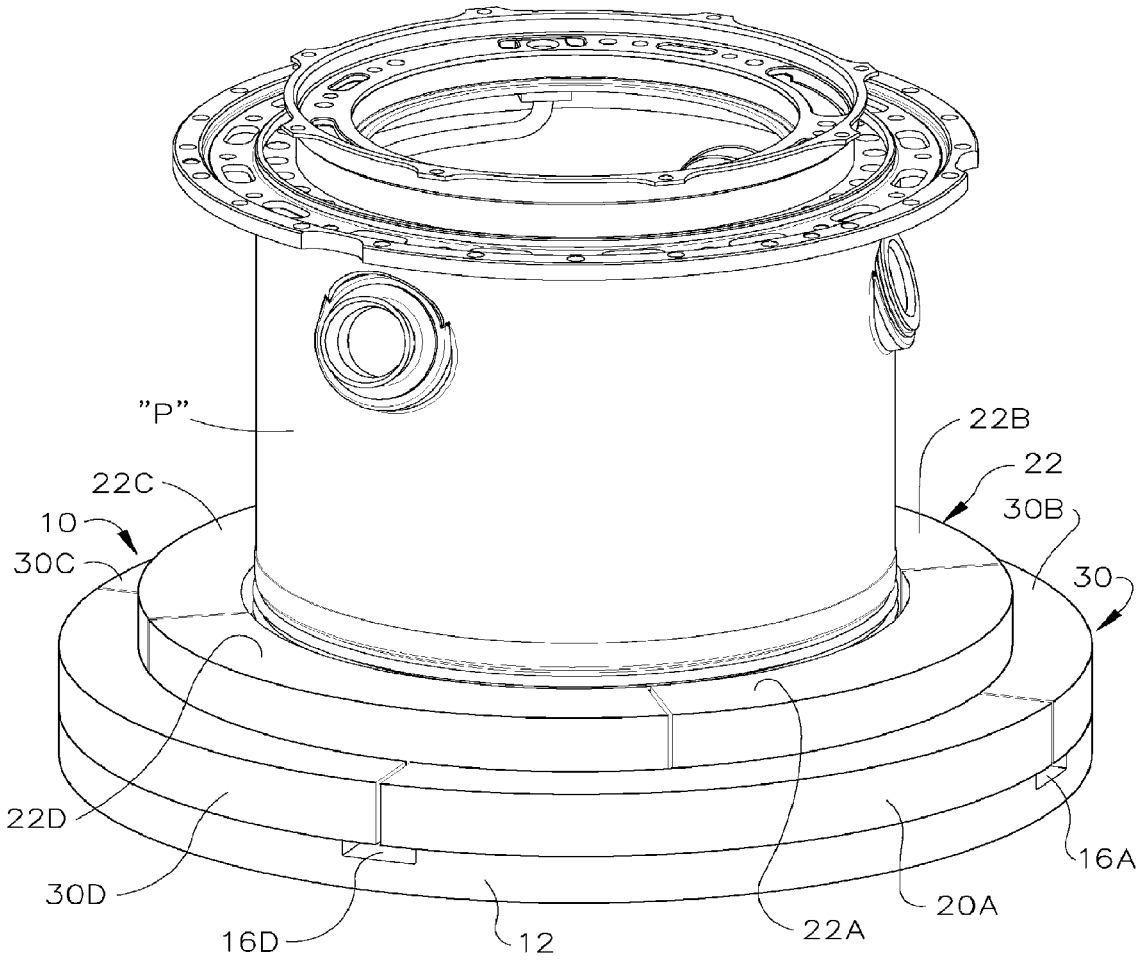
FIG. 1 is a perspective view of the engine part with a pair of flanges on which a fixture for preventing distortion during heat treatment is mounted.
Figure 2:
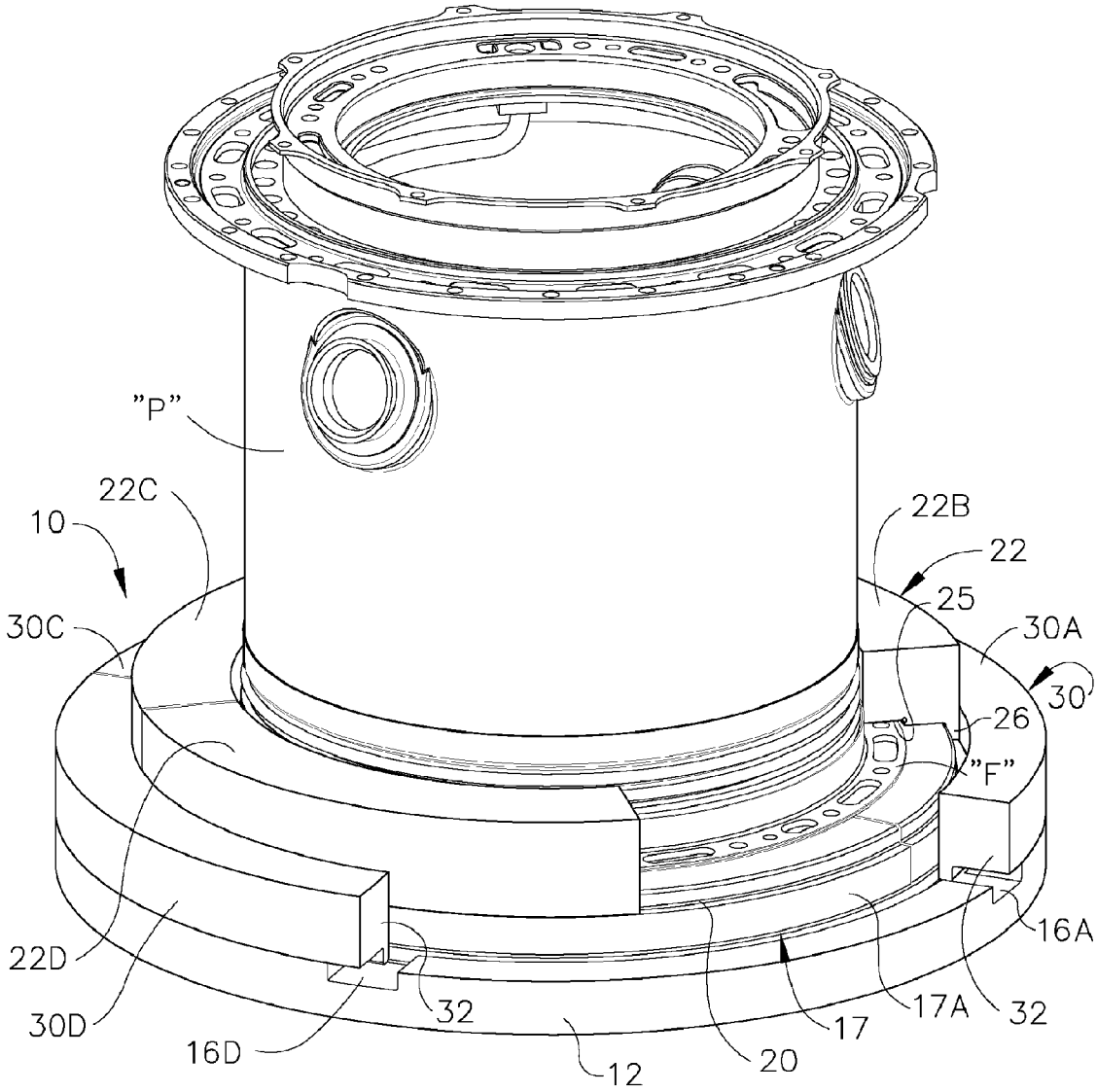
FIG. 2 is a perspective view of the engine part shown in FIG. 1, with parts of the fixture broken away for clarity.

Referring now specifically to the drawings, a distortion prevention fixture according to the present invention is illustrated in FIGS. 1-4 and shown generally at reference numeral 10. The fixture 10 is shown with an aircraft turbine engine part "P". The part "P" shown is a B-sump housing for purposes of illustration and explanation. The fixture 10 has general application on components having thin flanges, particularly with holes therein, that must be heat treated during repair.

The fixture 10 includes an annular base plate 12 and as many supports, such as segmented rings, as necessary to restrain the number of flanges on the part "P" that must be restrained. The base plate 12 includes a pair of annular grooves 13, 14 a central, annular void 15, and four notches 16A,B,C and D. The rings may be solid, one piece rings in circumstances where the rings can be fitted over and onto the part.

Figure 3:
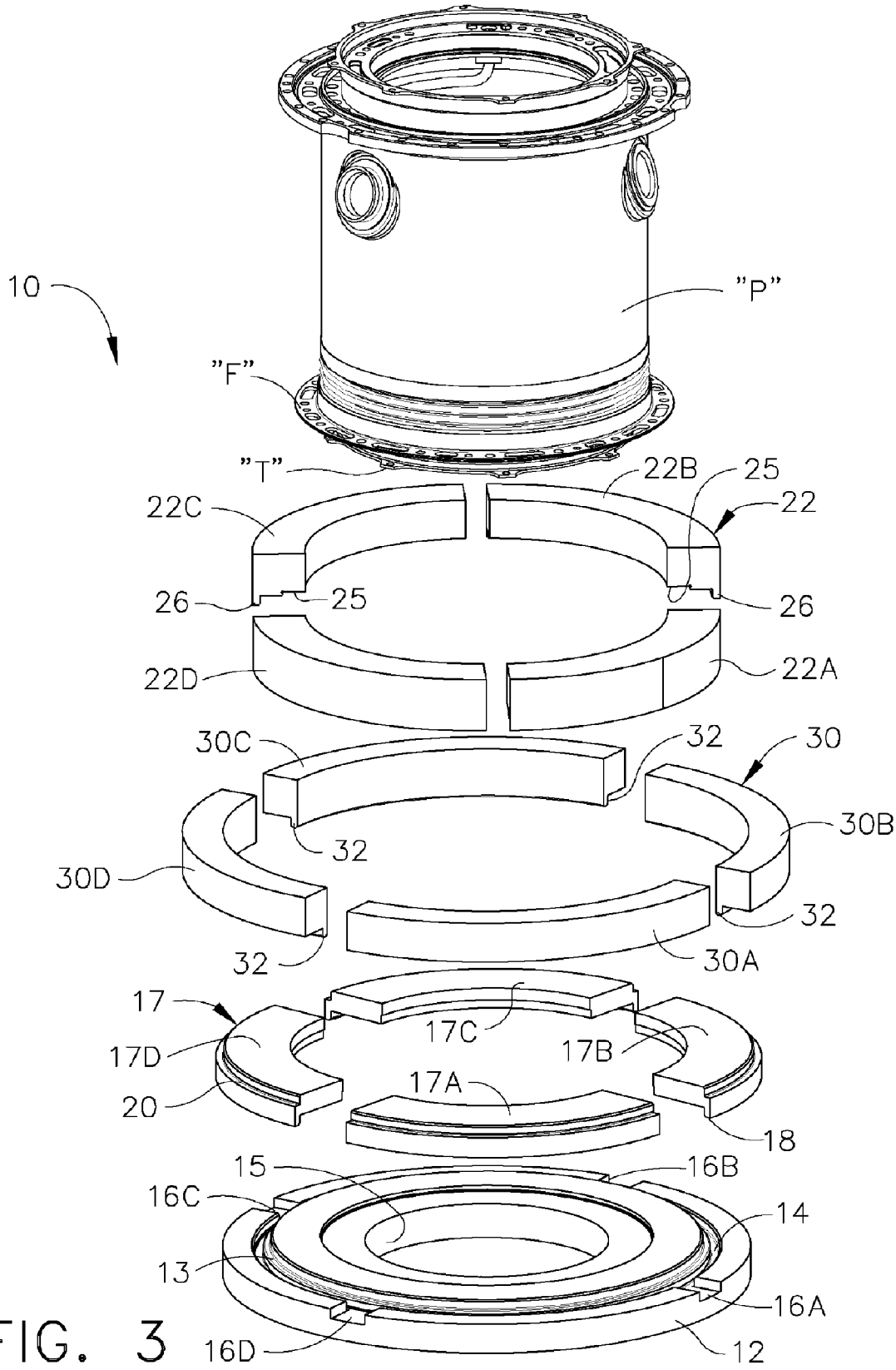
FIG. 3 is a perspective view of the engine part with the fixture parts exploded for clarity.
Figure 4:
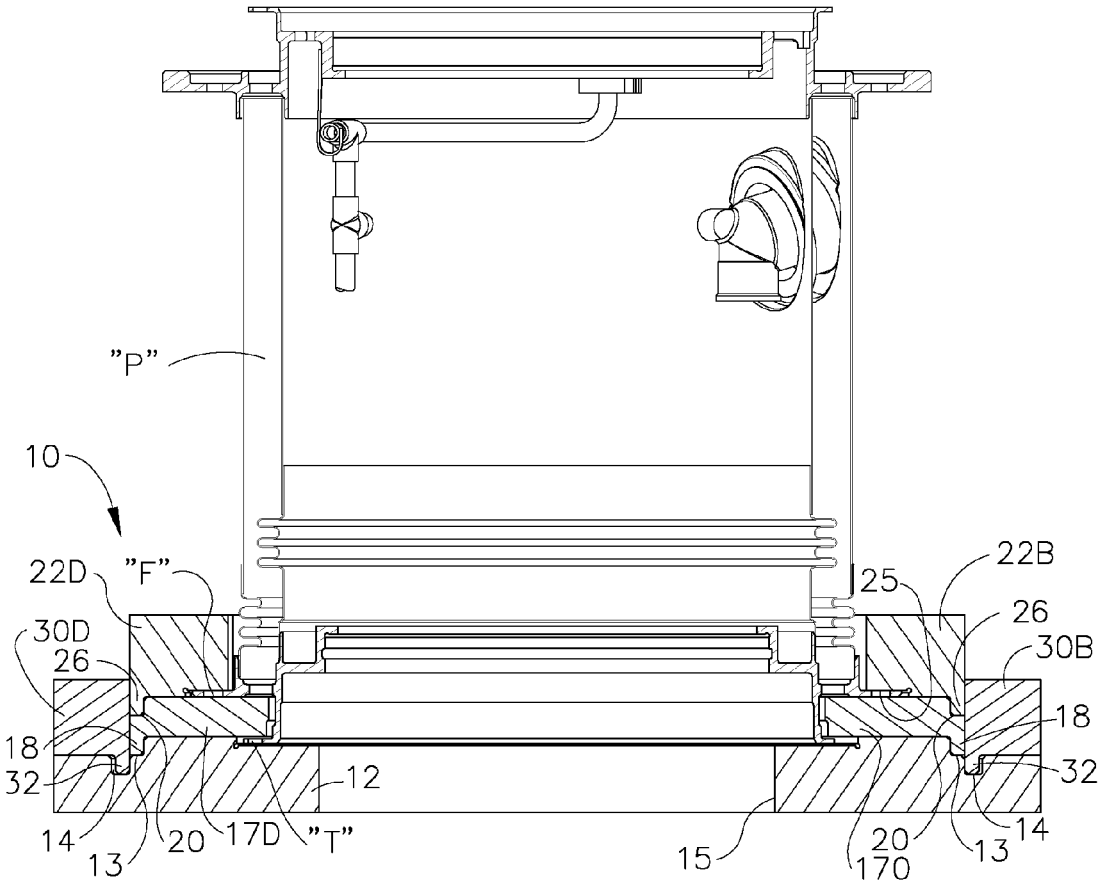
FIG. 4 is a vertical cross-section of the engine part and fixture shown in FIG. 1.

As is best shown in FIGS. 3 and 4, the "P" includes outwardly projecting tabs "T" and a thin flange "F" vertically spaced-apart from the tabs "T" that includes a plurality of spaced-apart bolt holes and slots. Thus, in the particular embodiment disclosed herein, a segmented intermediate ring 17 is positioned on top of the base plate 12 and directly beneath flange "F" to form a flat bottom support for the flange "F". The intermediate ring 17 includes a downwardly-extending lip 18 formed in the outer periphery that fits into groove 13 in the base plate 12 to lock the intermediate ring 17 into a fixed position relative to the base plate 12. Note, as is best shown in FIG. 3, that the intermediate ring 17 is formed of four arcuate ring segments 17A-D that are fitted together on the base plate 12 to collectively form the intermediate ring 17. The intermediate ring 17 also includes an annular recess 20 formed in its upper, outer periphery.

A segmented top ring 22 is provided and sits on the top surface of the intermediate ring 17. The top 22 ring has sufficient mass to maintain the flange "F" in a flat, non-distorted condition during heat treatment. The underside of the top ring 22 includes a bottom recess 25 to receive the flange "F", and a downwardly-extending lip 26 that locks into the recess 20 in the intermediate ring 17. See, particularly, FIGS. 2 and 4. The weight and material of the top ring 22 is predetermined so that the ring 22 will grow as needed during heat treatment without touching the side walls of the part "P", and keep the correct amount of weight on top of the flange "F". Note, as is best shown in FIG. 3, that the top ring 22 is formed of four ring segments 22A-D that are fitted together on the intermediate ring 17.

The base plate 12, the intermediate ring 17 and the top ring 22 are locked together by a segmented locking ring 30. Locking ring 30 has a downwardly-extending lip 32 that locks into the groove 14 in the base plate 12. See FIGS. 2 and 4. As is best shown in FIG. 3, that the locking ring 30 is formed of four ring segments 30A-D that are fitted together on the base plate 12 to collectively form the locking ring 30.

The setup and assembly of the base plate 12 and the intermediate and top rings 17, 22 keep the fixture 10 motionless, maintaining the correct dynamic gaps between the fixture 10 and the part "P", thereby preventing the fixture 10 from moving and engaging the side walls of the part "P" during the heat treatment operation. A fully-assembled fixture 10 mounted on part "P" is shown in FIG. 1.

During the heat treatment process the locking ring segments 30A-D may adhere to each other edge-to-edge making disassembly and removal of the fixture 10 from the part "P" difficult. Note in FIGS. 1 and 2 that notches 16A-D are placed at the locations where the locking ring segments 30A-D meet. Thus, if the locking ring segments 30A-D adhere to each other, a screwdriver or other tool with a flat blade may be inserted into one or more of the notches 16A-D and used to apply sufficient force to the locking ring segments 30A-D to separate them from each other and/or from the base plate 12.

As is evident from the foregoing, the fixture 10 is assembled and locked together on the flange "F" without bolts or other clamping means that could themselves distort or otherwise damage the flange "F". Assembly and disassembly is straightforward without the use of tools and with minimal expenditure of time and labor. The use of fixtures on parts having more than one flange is accomplished by using the required number of segmented rings and locking rings to lock the fixture into an immovable position during heat treatment.

EXAMPLE

A boltless heat treatment fixture was built and used on a repaired B-sump housing of a General Electric Co. CF34-3 turbine aircraft engine. Examination of the B-sump housing after heat treatment demonstrated that there was no deformation of the flanges in a furnace cycle with temperatures up to 982° C. The B-sump housing was allowed to grow freely and keep the flange flatness as required. During the age cycle (4 hours 982° C.), again with the use of the boltless heat treatment fixture 10, the flange "F" shrank back to its original dimension without any deformation.

A method and apparatus for eliminating distortion in thin flanges subject to heat treatment during a repair process is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A fixture for preventing distortion in a thin flange during heat treatment, comprising:

(a) a first support for engaging a bottom surface of the flange;

(b) a second support for engaging a top surface of the flange; and (c) boltless locking means for locking the first and second supports into a fixed position relative to each other and to the flange during the heat treatment;

(d) wherein the first support comprises a first ring formed of a first plurality of ring segments and the second support comprises a second ring formed of a second plurality of ring segments.

2. A fixture according to claim 1, wherein the boltless locking means comprises complementary lips and recesses formed on respective ones of the first support and the second support.

3. A fixture according to claim 2, wherein the boltless locking means includes a separate support for engaging the first and second supports and locking the first and second supports against movement relative to each other.

4. A fixture according to claim 1, wherein the boltless locking means comprises a locking ring formed of a plurality of locking ring segments.

5. A fixture according to claim 1, further comprising a base plate for supporting the first ring, the second ring, and the locking ring.

6. A fixture according to claim 5, wherein the base plate comprises a ring.

7. A fixture for preventing distortion in a thin annular flange on a turbine engine part during heat treatment, comprising:

(a) a base plate for supporting the engine part during heat treatment;

(b) a first segmented ring for being supported on the base plate and engaging a bottom surface of the flange;

(c) a second segmented ring for engaging a top surface of the flange;

(d) a boltless locking segmented ring for locking the first and second segmented rings into a fixed position relative to each other and to the flange during the heat treatment.

8. A fixture according to claim 7, and including a complementary lip and recess formed on respective ones of the first segmented ring and second segmented ring.

9. A fixture according to claim 8, wherein the locking segmented ring includes an annular lip for being positioned in a complementary, annular groove formed in the base plate.

10. A fixture according to claim 8, wherein the first segmented ring, the second segmented ring and the locking ring are each formed of a plurality of metallic, separable ring segments.

* * * * *